US007282845B2

(12) United States Patent
Hiramatsu

(10) Patent No.: US 7,282,845 B2
(45) Date of Patent: Oct. 16, 2007

(54) SPARK PLUG HAVING A PLURALITY OF CENTER ELECTRODES

(75) Inventor: Hiromi Hiramatsu, Kariya (JP)

(73) Assignee: Denso Corpoartion, Kariya, Aichi-Pref. (JP)

( * ) Notice: Subject to any disclaimer, the term of this patent is extended or adjusted under 35 U.S.C. 154(b) by 531 days.

(21) Appl. No.: 10/986,307

(22) Filed: Nov. 12, 2004

(65) Prior Publication Data

US 2005/0104495 A1 May 19, 2005

(30) Foreign Application Priority Data

Nov. 14, 2003 (JP) ..... 2003-385215

(51) Int. Cl.
*H01T 13/48* (2006.01)

(52) U.S. Cl. ..... 313/141; 313/143

(58) Field of Classification Search ..... 313/118–145
See application file for complete search history.

(56) References Cited

U.S. PATENT DOCUMENTS 1,560,512 A * 11/1925 Hirsch ..... 313/128
1,560,513 A * 11/1925 Hirsch ..... 313/123

FOREIGN PATENT DOCUMENTS

FR 2188915 A 1/1974
JP 57-193777 11/1982

OTHER PUBLICATIONS

French Search Report—Nov. 11, 2005.
Patent Abstracts of Japan, vol. 007, No. 044, (M-195), Feb. 22, 1983 & JP 57 193777 A(Nissan Jidosha KK), Nov. 29, 1982.

* cited by examiner

*Primary Examiner*—Nimeshkumar D. Patel
*Assistant Examiner*—Christopher M Raabe
(74) *Attorney, Agent, or Firm*—Nixon & Vanderhye P.C.

(57) ABSTRACT

A spark plug according to the invention includes a tubular metal shell, a cylindrical insulator, a plurality of center electrodes, and a plurality of ground electrodes. The meal shell has an end portion in which a plurality of thick-walled portions and a plurality of thin-walled portions are formed. The insulator is fixed in the metal shell. The center electrodes each are retained within one of a plurality of axial bores in the insulator. The ground electrodes each are joined to one of the thick-walled portions to ensure sufficient strength of the ground electrodes. The thin-walled portions each have an inner surface that is outwardly recessed in an angular range including the intersection of the inner surface with a reference line, thereby securing sufficient air pocket size of the spark plug. Accordingly, the spark plug has a high capability to ignite the air-fuel mixture and sufficient strength of the ground electrodes.

19 Claims, 10 Drawing Sheets

SPARK PLUG HAVING A PLURALITY OF CENTER ELECTRODES

CROSS-REFERENCE TO RELATED APPLICATION

This application claims priority from Japanese Patent Application No. 2003-385215, filed on Nov. 14, 2003, the content of which is hereby incorporated by reference into this application.

BACKGROUND OF THE INVENTION

1. Technical Field of the Invention

The present invention relates generally to spark plugs for use in automotive vehicles or cogeneration systems. More particularly, the invention relates to an improved structure of a spark plug that has a plurality of center electrodes. The improved structure of the spark plug ensures a high capability of the spark plug to ignite the air-fuel mixture and sufficient strength of ground electrodes of the spark plug.

2. Description of the Related Art

Conventional spark plugs for use in internal combustion engines generally include a tubular metal shell, an insulator, a center electrode, and a ground electrode.

The metal shell has a male threaded portion for fitting the spark plug into a combustion chamber of the engine. The insulator has a center bore formed therein and is fixed in the metal shell such that an end thereof protrudes from an end of the metal shell. The center electrode is secured in the center bore of the insulator such that an end thereof protrudes from the end of the insulator. The ground electrode has a side surface, and is joined to the end of the metal shell such that the side surface thereof is opposed to and spaced from the end of the center electrode so as to form a spark gap therebetween.

In recent years, an increase of compression ratios of internal combustion engines has been pursued for the purpose of increasing power output and improving fuel economies. However, at the same time, such an increase in the compression ratio of an internal combustion engine may cause knocking of the engine, which involves vibrations and damage to the engine.

A possible way of avoiding the engine knocking is to accelerate the combustion within a combustion chamber of the engine so as to complete the combustion cycle of the engine before the engine knocking occurs.

It has been known to be effective to provide a plurality of separate sparks to the combustion chamber, in other words, to initiate the combustion at a plurality of spaced points within the single combustion chamber. By providing more than one spark simultaneously, the time required for the flame to propagate across the combustion chamber can be greatly reduced, thereby effectively accelerating the combustion.

In order to provide a plurality of separate sparks to a single combustion chamber, Japanese Unexamined Patent Publication No. S57-193777 discloses, for example, a spark plug that has a plurality of center electrodes.

On the other hand, an increase in the compression ratio of an internal combustion engine, as described above, may also cause an increase in the required spark voltage (i.e., the electric voltage required for sparking) of a spark plug used for the engine.

Such increase in the required spark voltage implies that it becomes difficult for the spark plug to generate sparks in a spark gap of the spark plug. Thus, instead of normal sparks being generated in the spark gap, "side sparks" can be generated.

The side sparks are sparks which creep from a center electrode of the spark plug along the outer surface of the insulator, and fly to the metal shell of the spark plug. More specifically, the side sparks fly over an air pocket formed between the outer surface of the insulator and the inner surface of the metal shell, thus resulting in engine misfires. Consequently, when the side sparks are generated, the performance of the engine will drop.

Moreover, the recent demand for higher power output of an internal combustion engine has required increasing the sizes of intake and exhaust valves for the engine and securing a water jacket for cooling of the engine. As a consequence, a spark plug to be used for the engine which has a plurality of center electrodes, is required to have a limited size not greater than that of a conventional spark plug which has only one center electrode.

This limitation on the size of the spark plug which even has more than one center electrode necessitates a decrease in an air pocket size of the spark plug; the air pocket size is defined herein as the minimum distance between the inner surface of the metal shell and the outer surface of the insulator on a reference plane that includes the end of the metal shell.

However, in addition to the increase in the required spark voltage of the spark plug as described above, the decreased air pocket size of the spark plug may also cause side sparks in the spark plug.

Accordingly, it is required to keep the air pocket size of the spark plug above a certain level, under the limitation on the size of the spark plug, so as to prevent generation of side sparks.

One may consider, for the purpose of securing the air pocket size of the spark plug, enlarging the inner surface of the metal shell so that it is concentric with the outer surface of the same. However, this will result in a decrease in the wall thickness of the metal shell at the end thereof, so that only those ground electrodes that are thin and have a small cross-sectional area can be joined to the end of the metal shell. Consequently, it becomes impossible to secure sufficient strength of the ground electrodes.

Furthermore, since the inner surface of the metal shell of the spark plug is enlarged in comparison with that of a conventional spark plug having the same size and thermal value, the volume of the air pocket formed between the outer surface of the insulator and the inner surface of the metal shell is accordingly increased. Thus, a considerable amount of combustion gas will flow into the air pocket, thereby transferring more heat to the spark plug. As a consequence, the temperature of the end portion of the spark plug that is disposed in the combustion chamber increases accordingly, resulting in pre-ignition of the air-fuel mixture and performance decrement of the engine.

SUMMARY OF THE INVENTION

It is, therefore, a primary object of the present invention to provide a spark plug that has a plurality of center electrodes and an improved structure; the improved structure prevents generation of side sparks in the spark plug without sacrificing the strength of the ground electrodes of the spark plug.

According to the invention, a spark plug is provided which includes a tubular metal shell, a cylindrical insulator, a plurality of center electrodes, a plurality of thick-walled portions, a plurality of ground electrodes, and a plurality of thin-walled portions.

The tubular metal shell has an axis; it also has a first end portion to be disposed in a combustion chamber of an internal combustion engine and a second end portion opposed to the first end portion.

The cylindrical insulator is fixed in the metal shell. The insulator has a first end exposed outside the first end portion of the metal shell and a second end opposite to the first end; it also has a plurality of bores formed therein which extend from the first end to the second end of the insulator.

The plurality of center electrodes each are retained within one of the bores in the insulator; each of the center electrodes has an axis.

The plurality of thick-walled portions is formed in the first end portion of the metal shell; the plurality of ground electrodes each are joined to one of the plurality of thick-walled portions.

The plurality of thin-walled portions is also formed in the first end portion of the metal shell. Each of the thin-walled portions has an inner surface which is outwardly recessed in an angular range that includes the intersection of the inner surface with a reference line; the reference line is defined to extend from the axis of the metal shell through the axis of one of the plurality of center electrodes on a reference plane that is defined to extend perpendicular to the axis of the metal shell through an inner edge of the first end portion of the metal shell.

In a conventional spark plug that has a plurality of center electrodes, the distance between the metal shell and the insulator has the minimum value on a reference line that has the same definition as the above-defined reference line of the spark plug of the invention; side sparks are mostly generated in such a place where the distance between the metal shell and the insulator is shortest.

Compared to conventional spark plugs having a plurality of center electrodes, the spark plug according to the invention has the plurality of thin-walled portions each of which is arranged such that the inner surface thereof intersects with the reference line, so that the minimum distance between the metal shell and the insulator on the reference plane is increased.

It is preferable that, on the reference plane, the minimum distance between the metal shell and the insulator in radial direction of the metal shell is in the range of 1.2 to 1.6 mm.

As a result, a sufficiently large air pocket size of the spark plug is secured; thereby preventing generation of side sparks.

Further, in the spark plug according to the invention, each of the plurality of ground electrodes is joined to one of the plurality of thick-walled portions.

It is preferable that each of the thick-walled portions of the metal shell has a thickness greater than or equal to 0.8 mm; it is also preferable that each of the ground electrodes is joined to a part of one of the thick-walled portions which intersects, on the reference plane, with a line extending through the axis of one of the plurality of center electrodes perpendicular to the reference line that passes the axis of the center electrode.

Additionally, according to a preferred embodiment of the invention, the metal shell has an annular ridge that extends inwardly from the inner surface of the metal shell and is spaced from the first end portion of the metal shell; all the thick-walled portions are formed closer to the axis of the metal shell than the annular ridge of the metal shell.

As a consequence, the ground electrodes that have a large cross-sectional area and sufficient strength are joined to the thick-walled portions, without reducing the air pocket size of the spark plug.

Accordingly, the spark plug according to the invention has an improved structure that ensures sufficient strength of the ground electrodes of the spark plug, while preventing generation of side sparks in the spark plug, so as to enhance the capability of the spark plug to ignite the air-fuel mixture.

Furthermore, it is preferable that, in the spark plug according to the invention, the first end portion of the metal shell has a cross-sectional area on the reference plane greater than or equal to 39.2 $mm^2$.

Specifying the cross-sectional area of the spark plug as above, the volume of the air pocket that is formed between the inner surface of the metal shell and the outer surface of the insulator can be reduced, thereby reliably preventing pre-ignition of the air-fuel mixture.

It is also preferable that, in the spark plug according to the invention, a portion of the insulator, which is surrounded by the first end portion of the metal shell, has a minimum thickness of side walls forming the plurality of bores in the insulator in the range of 0.5 to 0.8 mm.

Specifying the minimum thickness of the insulator as above, the insulation performance of the insulator (i.e., the withstand voltage thereof) can be secured.

Moreover, it is also preferable that, in the spark plug according to the invention, each of the plurality of thin-walled portions has a cut formed therein.

The cut is formed through cutting away the thinnest part of the thin-walled portion in advance, so that collapse of the first end portion of the metal shell is prevented, thus permitting the spark plug to be smoothly fit in or removed from the combustion chamber of the engine.

Additionally, in the spark plug according to the invention, an inner surface of the first end portion of the metal shell may be formed with a plurality of circular arcs. More particularly, the inner surface of the first end portion of the metal shell may be formed with a plurality of circular arcs each of which has a center on the axis of one of the plurality of center electrodes, and a plurality of circular arcs each of which has a center on the axis of the metal shell.

The inner surface of the first end portion of the metal shell may also be formed with an ellipse, a polygon, or a combination of a plurality of circular arcs and a plurality of straight lines.

BRIEF DESCRIPTION OF THE DRAWINGS

The present invention will be understood more fully from the detailed description given hereinafter and from the accompanying drawings of the preferred embodiments of the invention, which, however, should not be taken to limit the invention to the specific embodiments but are for the purpose of explanation and understanding only.

In the accompanying drawings.

DESCRIPTION OF THE PREFERRED EMBODIMENTS

Figure 1A:
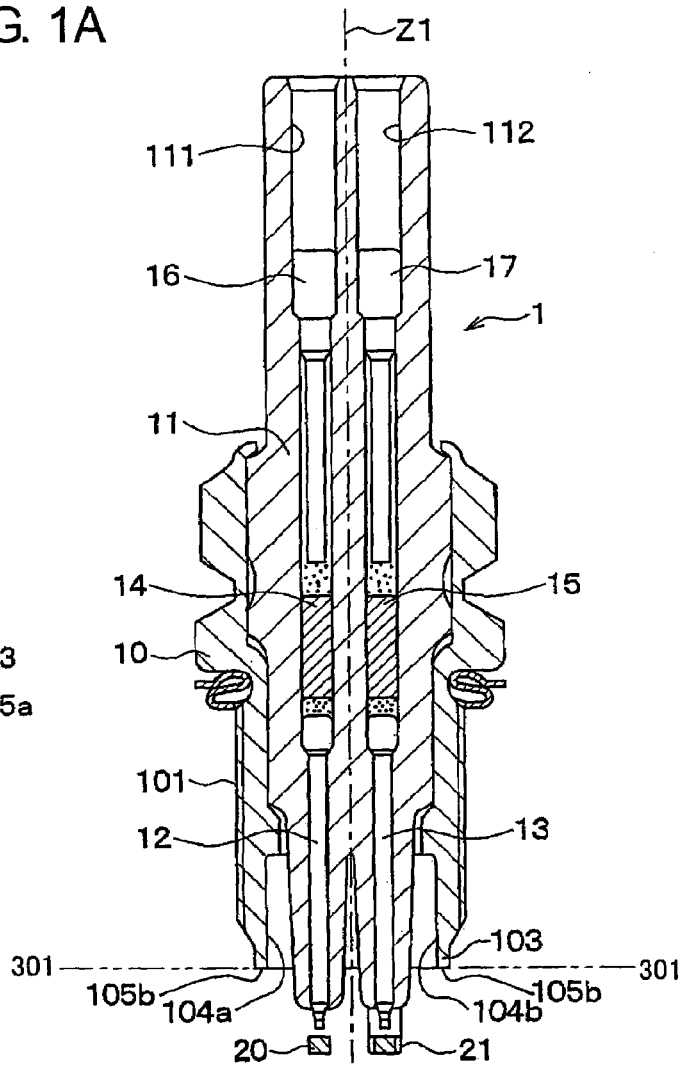
FIG. 1A is a partially cross-sectional side view showing an overall structure of a spark plug according to the first embodiment of the invention.

The preferred embodiments of the present invention will be described hereinafter with reference to FIGS. 1-18.

It should be noted that, for the sake of clarity and understanding, identical components having identical functions in different embodiments of the invention have been marked, where possible, with the same reference numerals in each of the figures.

First Embodiment

FIG. 1 shows an overall structure of a spark plug 1 according to the first embodiment of the invention.

The spark plug 1 has a pair of separate spark gaps 31 and 32 to ignite the air-fuel mixture at two spaced points in a combustion chamber of an internal combustion engine. When the spark plug 1 is installed to the engine (not shown), both of the spark gaps 31 and 32 will be located within the single combustion chamber (not shown), thereby igniting the air-fuel mixture by means of sparks generated in the two separate spark gaps.

As shown in FIG. 1, the spark plug 1 includes a metal shell 10, an insulator 11, a pair of center electrodes 12 and 13, and a pair of ground electrodes 20 and 21.

The metal shell 10 has a substantially tubular shape, and is made of conductive metal material, for example low-carbon steel. The metal shell 10 is provided with a male threaded portion 101 that is adapted to engage a cooperating female threaded opening provided in the combustion chamber.

The insulator 11, which has a cylindrical shape, is fixed to and partially contained in the metal shell 10 such that both ends thereof protrudes from the metal shell 10. The insulator 11 is made of alumina ceramic ($Al_2O_3$).

Figure 2:
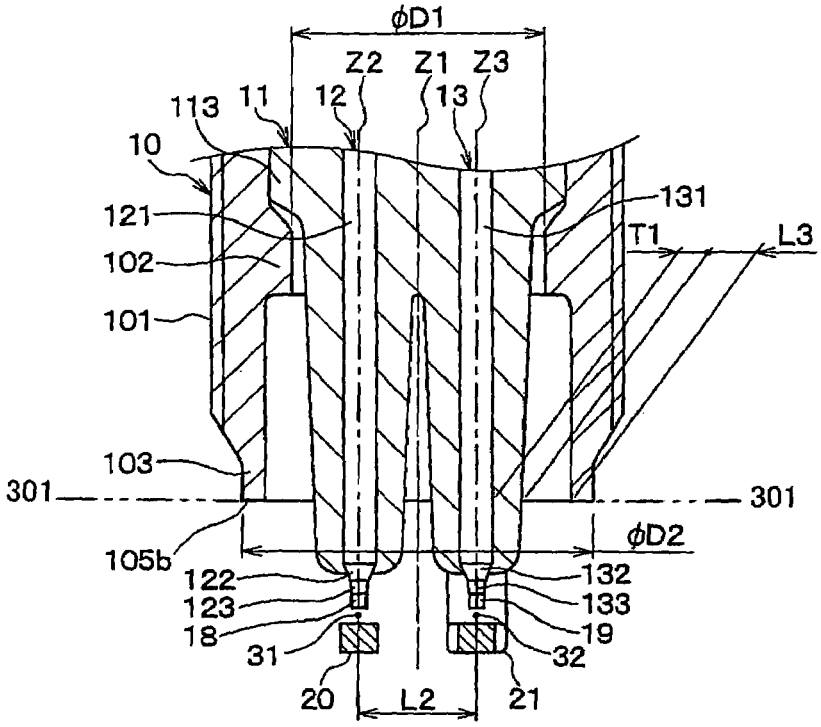
FIG. 2 is an enlarged partially cross-sectional side view showing two spark gaps and their vicinity in the spark plug of FIG. 1.

Referring now to FIG. 2, the metal shell 10 has also an annular ridge 102 that extends inwardly from the inner surface of the metal shell 10. On the contrary, the insulator 11 is provided with a frustoconical portion 113 that is tapered downwardly and has an outer surface facing the annular ridge 102 of the metal shell 10. A ring-shaped gasket (not shown) is disposed between the annular ridge 102 of the metal shell 10 and the frustoconical portion 113 of the insulator 11 for forming a gas-tight seal between the metal shell 10 and the insulator 11. In addition, the annular ridge 102 of the metal shell 10 has an inner diameter D1 that is referred to as ridge diameter D1 hereinafter.

Turning to FIG. 1, both of the tubular metal shell 10 and the cylindrical insulator 11 have an axis; the axes of the metal shell 10 and the insulator 11 coincide with each other and together define an axis Z1 of the spark plug 1. The insulator 11 has two bores 111 and 112 formed therein, which extend in a direction substantially parallel to and on either side of the axis Z1.

The center electrodes 12 and 13 are made of conductive Ni-based alloy and each have a substantially cylindrical shape. The center electrode 12 is disposed in the bore 111 of the insulator 11 together with a carbon resistive element 14 and a cylindrical stem 16; while, the center electrode 13, a carbon resistive element 15 and a cylindrical stem 17 are positioned in the other bore 112 of the insulator 11. Both of the stems 16 and 17 are made of conductive metal material, for example low-carbon steel. All voids between those components within the bores 111 and 112 are filled with conductive glass material for sealing.

Further, the center electrode 12 has, as shown in the FIG. 2, a cylindrical main body portion 121 retained in the bore 111 of the insulator 11 and a shoulder 122 abutting the main body portion 121 at the end thereof. Similarly, the center electrode 13 includes a cylindrical main body portion 131 and a shoulder 132. In this embodiment, both of the shoulder 122 and 132 have, for example, a frustoconical shape.

To the ends of the shoulders 122 and 132 that are on the opposite side of the main body portions 121 and 131, cylindrical chips 18 and 19 that have smaller diameter than the main body portions 121 and 131 are respectively joined by laser welding. Due to the use of laser welding, in this embodiment, there are weld layers 123 and 133 formed between the shoulder 122 and the chip 18 and between the shoulder 123 and the chip 19, respectively.

The two chips 18 and 19 are made of a noble metal or its alloy, for example an alloy of Ir (Iridium) and Rh(Rhodium) that has a high melting point, more particularly IR-10Rh. Furthermore, considering the wear-resistance, the two chips 18 and 19 are preferably made of an Ir-based alloy including Ir in an amount of greater than 50 weight %.

Each of the two stems 16 and 17 is provided with a terminal formed at the end thereof that is on the opposite side of the center electrode; a cable leading to high-voltage is connected to the terminal. It is necessary to note that those terminals can be formed either individually or integrally with the stem 16 or 17. Those terminals are embedded in the insulator 11 so as to maintain a necessary insulation distance therebetween.

The metal shell 10 has an end portion 103 that is to be located in the combustion chamber. The end portion 103 includes an end to which the pair of ground electrodes 20 and 21 made of conductive Ni-based alloy is welded. Both of the ground electrodes 20 and 21 are bent or angled substantially 90 degrees, thus forming L-shape.

The ground electrode 20 includes a leg portion 201 that extends from the end of the metal shell 10 parallel to the axis Z1 and a facing portion 202 that extends from the leg portion 201 perpendicular to the axis Z1. Similarly, the ground electrode 21 has a leg portion 211 parallel to the axis Z1 and a facing portion 212 perpendicular to the axis Z1.

As a result, the chip 18 joined to the center electrode 12 and the facing portion 202 of the ground electrode 20 face each other through the spark gap 31; while, the chip 19 joined to the center electrode 19 and the facing portion 212 of the ground electrode 21 is in opposed relationship through the spark gap 32.

Figure 3:
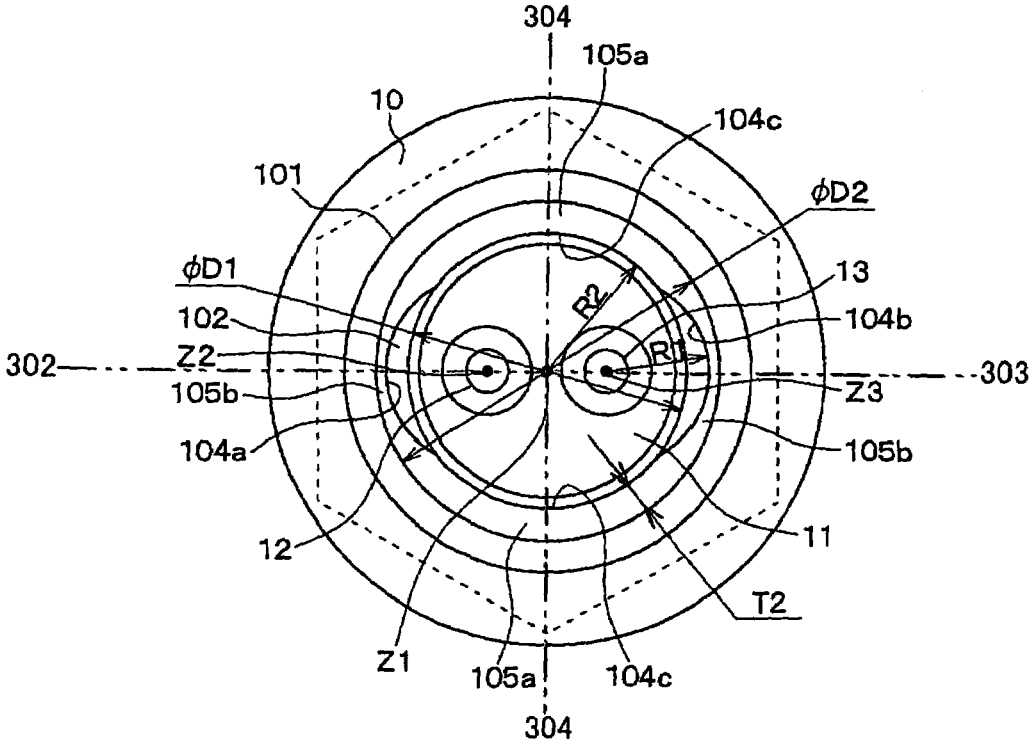
FIG. 3 is an end view of the spark plug of FIG. 1A omitting its ground electrodes from the bottom end thereof.

Referring to FIG. 3, there is shown the shape of the end portion 103 of the metal shell 10, viewed along the axis Z1, omitting the ground electrodes 20 and 21 joined thereto.

The end portion 103 of the metal shell 10 has, as shown in FIG. 3, a cylindrical outer surface, the diameter D2 of which is referred to as the outer diameter D2 of the end portion 103 hereinafter. On the contrary, the inner surface of the end portion 103 of the metal shell 10 is non-cylindrical. More specifically, the inner surface of the end portion 103 is composed of a first section 104*a*, a second section 104*b*, a third section 104*c*, and a fourth section 104*d*. The first section 104*a* and the second section 104*b* are formed on the basis of a circular arc that has the center thereof on the axis Z2 of the center electrode 12 and a circular arc that has the same on the axis Z3 of the center electrode 13; while the third section 104*c* and the fourth section 104*d* are formed on the basis of two circular arcs sharing a common center on the axis Z1 of the spark plug 1.

Consequently, making the outer and the inner surface of the end portion 103 of the metal shell 10 being cylindrical and non-cylindrical respectively, a pair of thick-walled portions 105*a* and a pair of thin-walled portions 105*b* is formed in the end portion 103. The pair of thick-walled portions 105*a* has the inner surfaces thereof corresponding to the third and fourth sections 104*c* and 104*d* of the inner surface of the end portion 103, while the pair of thin-walled portions 105*b* has the inner surfaces thereof corresponding to the first and second sections 104*a* and 104*b* of the same.

Furthermore, the pair of thick-walled portions 105*a* and the pair of thin-walled portions 105*b* is so alternately disposed in the circumferential direction of the metal shell 10 that the section 104*a* and the section 104*b* intersect, at the centers thereof, with a first reference line 302 and a second reference line 303 respectively, while the third section 104*c* and the fourth section 104*d* intersect, at the centers thereof, with a third reference line 304. The first reference line 302 is defined to extend from the axis Z1 of the spark plug 1 through the axis Z2 of the center electrode 12 on a reference plane 301 that is defined to extend perpendicular to the axis Z1 through the inner edge of the end portion 103 of the metal shell 10. Similarly, the second reference line 303 is defined to extend from the axis Z1 of the spark plug 1 through the axis Z3 of the center electrode 13 on the reference plane 301. On the contrary, the third reference line 304 is defined to extend perpendicular to the first reference line 302 or the second reference line 303 through the axis Z1 of the spark plug 1.

In a conventional spark plug that includes a plurality of center electrodes, the distance between the inner surface of the metal shell and the outer surface of the insulator on the plane that includes the end of the metal shell generally has the minimum value on a reference line extending from the spark plug axis through the axis of one of the plurality of the center electrodes. As described previously, the minimum value is defined as the air pocket size of the spark plug, and when the air pocket size is not sufficiently large, side-sparks can be generated in the spark plug.

Since the spark plug 1 according to the present embodiment has the pair of thin-walled portions 105*b* the inner surfaces of which intersect with the first and second reference lines 302 and 303 respectively, so that a sufficiently large air pocket size of the spark plug 1 is secured, thereby preventing generation of side sparks.

In addition, the radius R1 of the two circular arcs, with which the first and second sections 104*a* and 104*b* of the inner surface of the metal shell end portion 103 are formed, is determined based on an air pocket size of the spark plug 1 necessary to suppress generation of side sparks. The third and fourth sections 104*c* and 104*d* of the inner surface of the metal shell end portion 103 have been machined, in this embodiment, simultaneously with the inner surface of the annular ridge 102 of the metal shell 10. Accordingly, the two sections 104*c* and 104*d* have a radius R2 equal to a half of the ridge diameter D1.

Figure 1C:
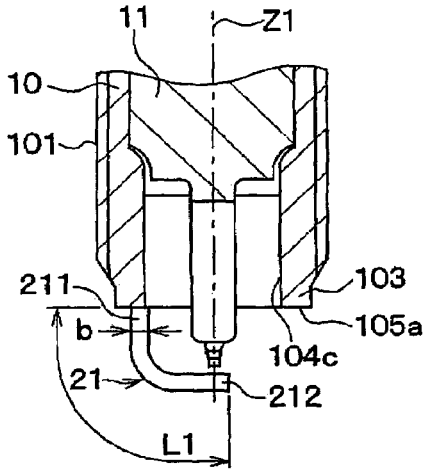
FIG. 1C is a partially cross-sectional side view showing a substantial part of the spark plug of FIG. 1 from the left side thereof.
Figure 1B:
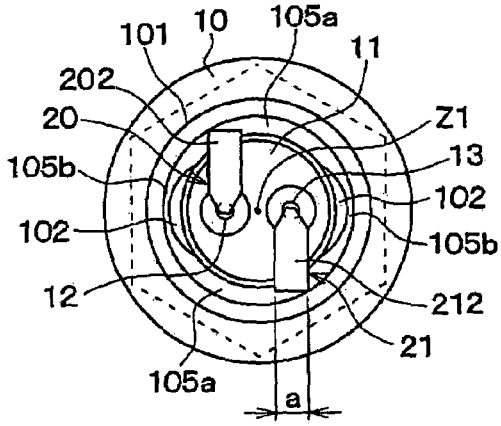
FIG. 1B is an end view of the spark plug of FIG. 1A from the bottom end thereof.

Referring to FIG. 1B and FIG. 3, the ground electrodes 20 and 21 are joined to the pair of thick-walled portions 105*a* of the metal shell end portion 103.

More specifically, the two ground electrodes are so arranged that, when viewed along the axis Z1 of the spark plug 1, they are parallel to each other. The ground electrode 20 is joined to a part of one of the pair of thick-walled portions 105*a* which intersects with a line that extends from the axis Z2 of the center electrode 12 perpendicular to the first reference line 302. Similarly, the ground electrode 21 is joined to a part of the other thick-walled portion 105*a* which intersects with a line that extends from the axis Z3 of the center electrode 13 perpendicular to the second reference line 303.

Having arranged the two ground electrodes 20 and 21 as described above, the distances between the center electrode 12 and the ground electrode 20 and between the center electrode 13 and the ground electrode 21 become short, thereby preventing the two ground electrodes from being too long.

Furthermore, the pair of thick-walled portions 105*a* is so disposed that the distances therefrom to the two center electrodes 12 and 13 are sufficiently large. Thus, ground electrodes 20 and 21 that have a large cross-sectional area and sufficient strength are joined to the pair of thick-walled portions 105*a* without reducing the air pocket size of the spark plug 1.

As shown in FIGS. 1B and 1C, each of the leg portions 201 and 211 of the ground electrodes 20 and 21 has, at the end thereof abutting the metal shell 10, an end surface area S and a pair of side-lengths a and b. The ground electrodes 20 and 21 each have a length L1 between the end of the leg portion abutting the metal shell 10 and the end of the facing portion thereof. In order to secure sufficient strength in practical use, it is preferable that each of the side-lengths a and b is not smaller than 0.8 mm, and the ratio of S/L1 is greater than 0.16.

Moreover, in the spark plug 1, the end surface area of the metal shell end portion 103 is increased with the help of the pair of the thick-walled portions 105*a*. As a consequence, the volume of the air pocket that is formed between the inner surface of the metal shell 10 and the outer surface of the insulator 11 is reduced, thereby preventing pre-ignition of the air-fuel mixture. Specifically, when the ridge diameter D1 of the spark plug 1 is 12 mm, the pre-ignition is reliably prevented through specifying the end surface area of the metal shell end portion 103 being not smaller than 39.2 $mm^2$.

For the spark plug 1 that has so far been described, the effect of the parameters on the occurrence rate of dielectric breakdown and on the occurrence rate of side sparks has been investigated.

First, the relationship between the insulation thickness T1 of the insulator 11 and the occurrence rate of dielectric breakdown of the spark plug 1 has been determined through an experimental investigation.

The insulation thickness T1 is, as shown in FIG. 2, the minimum thickness of the insulator 11 in the portion thereof that is surrounded by the metal shell end portion 103. The insulation thickness T1 influences the capability of the spark plug 1 in preventing dielectric breakdown thereof (i.e., securing withstand voltage of the spark plug 1).

Figure 4:
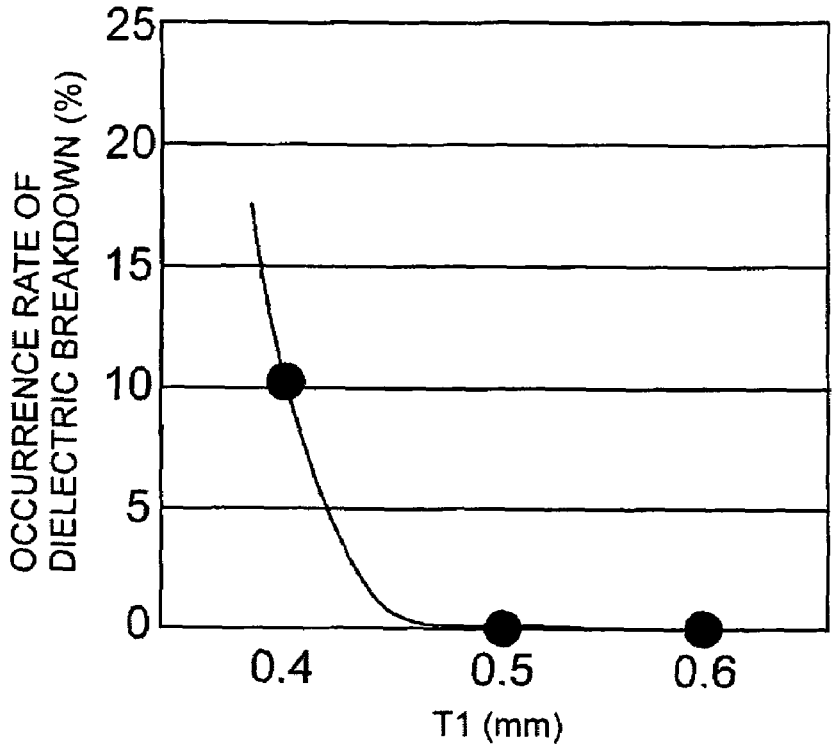
FIG. 4 is a graphical representation showing investigation results on the relationship between a thickness of an insulator of the spark plug of FIG. 1A and the occurrence rate of dielectric breakdown of the spark plug.

FIG. 4 shows the investigation results on the relationship between the insulation thickness T1 and the occurrence rate of dielectric breakdown of the spark plug 1. The investigation was conducted using a four-cylinder, 1800 cc engine under an operating condition where the engine load was repeatedly varied 10 times at the engine speed of 1000 rpm from idling to a full throttle acceleration; in that operating condition, required spark voltage is generally high and accordingly dielectric breakdown of the spark plug tends to occur.

Spark plugs tested in the investigation had a structure in which the outer diameter of the male threaded portion 101 of the metal shell 10 is 14 mm; the distance L2 between the axis Z2 of the center electrode 12 and the axis Z3 of the center electrode 13 is 4 mm; the ridge diameter D1 is 8.5 mm; the outer diameter D2 of the metal shell end portion 103 is 12 mm; the radius R1 for forming the pair of thin-walled portions 105*b* of the metal shell end portion 103 is 3.25 mm; and the radius R2 for forming the pair of thick-walled portions 105*a* of metal shell end portion 103 is 4.25 mm.

In the investigation, the insulation thickness T1 was varied to determine the resultant occurrence rate of dielectric breakdown of the spark plug. Specifically, for each of the three given insulation thicknesses T1 of 0.4 mm, 0.5 mm, and 0.6 mm, 40 spark plugs that have the same given insulation thickness T1 were tested; the ratio of the number of the spark plugs where the dielectric breakdown occurred to the total number of 40 was counted as the occurrence rate of dielectric breakdown for the given insulation thickness T1.

It can be seen from FIG. 4 that, when the insulation thickness T1 of the insulator 11 is greater than or equal to 0.7 mm, the withstand voltage of the spark plug 1 is secured, thereby preventing dielectric breakdown thereof.

Moreover, spark plugs, which have a metal shell having a male threaded portion with an outer diameter not greater than 14 mm, are generally subject to dimensional constraints including the sizes of electrodes, the spaces available for accommodating electrodes, and the disposition spaces. Due to such dimensional constraints, those spark plugs generally have an upper limit of the insulation thickness T1 equal to 0.8 mm.

Accordingly, in the present embodiment, the dimensional range of the insulation thickness T1 has been specified for the spark plug 1 such that T1 is in the range of 0.5 to 0.8 mm.

Next, the relationship between the air pocket size L3 of the spark plug 1 and the occurrence rate of side sparks in the spark plug has been determined through an experimental investigation.

As described previously, the air pocket size L3 has a great effect on the capability of the spark plug 1 in suppressing generation of side sparks. Since side sparks fly over the air pocket to the metal shell 10, a greater air pocket size L3 is more advantageous in suppressing generation of side sparks.

Figure 5:
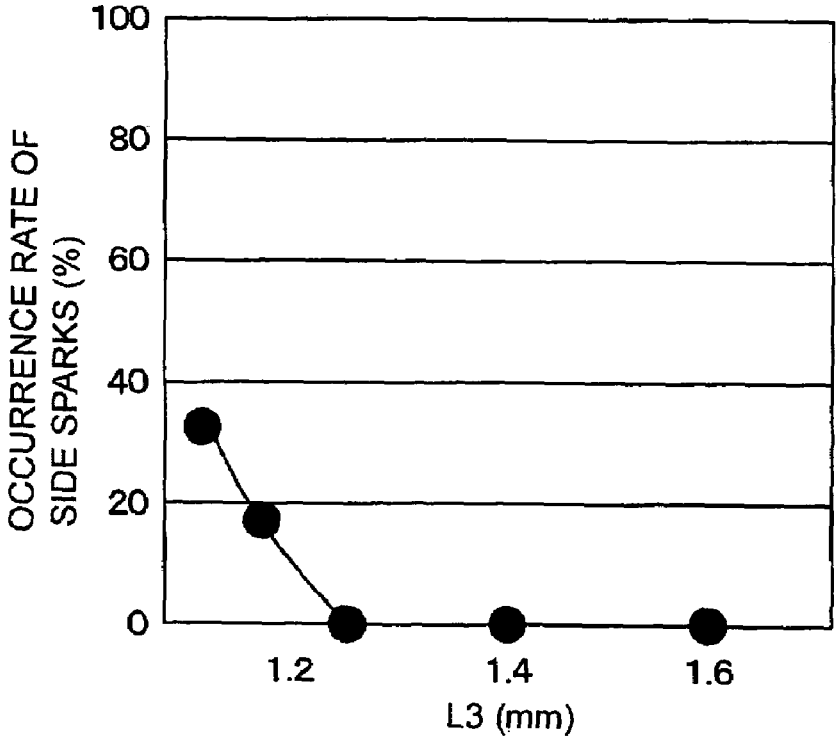
FIG. 5 is a graphical representation showing investigation results on the relationship between an air pocket size of the spark plug of FIG. 1A and the occurrence rate of side sparks in the spark plug.

FIG. 5 shows the investigation results on the relationship between the air pocket size L3 and the occurrence rate of side sparks (i.e., the probability of occurrence of side sparks). The investigation was conducted using a four-cylinder, 1800 cc engine under an idling condition where the engine speed is 800 rpm, and the cooling water temperature is 50 degrees Celsius.

Spark plugs tested in the investigation had a structure in which the outer diameter of the male threaded portion 101 of the metal shell 10 is 14 mm; the distance L2 between the axis Z2 of the center electrode 12 and the axis Z3 of the center electrode 13 is 4 mm; the ridge diameter D1 is 8.5 mm; the outer diameter D2 of the metal shell end portion 103 is 12 mm; the radius R1 for forming the pair of thin-walled portions 105*b* of the metal shell end portion 103 is 3.25 mm; and the radius R2 for forming the pair of thick-walled portions 105*a* of metal shell end portion 103 is 4.25 mm. The air pocket size L3 in those spark plugs was varied to determine the resultant occurrence rate of side sparks.

It can be seen from FIG. 5 that, when the air pocket size L3 is greater than or equal to 1.2 mm, generation of side sparks in the spark plug is completely suppressed.

Furthermore, spark plugs, which have a metal shell having a threaded portion with an outer diameter not greater than 14 mm, are generally subject to the dimensional constraints as described above. Due to the dimensional constraints, those spark plugs generally have an upper limit of the air pocket size L3 equal to 1.6 mm.

Accordingly, in the present embodiment, the dimensional range of the air pocket size L3 has been specified for the spark plug 1 such that L3 is in the range of 1.2 to 1.6 mm.

To sum up, the spark plug 1 according to the present embodiment, which includes the pair of center electrodes 12 and 13, has an improved structure where a pair of thick-walled portions 105*a* and a pair of thin-walled portions 105*b* is formed in the metal shell end portion 103.

The pair of thin-walled portions 105*b* is arranged in those places where the distance between the inner surface of the metal shell 10 and the outer surface of the insulator 11 generally has the smallest value without it; specifically, it is so arranged that the inner surfaces thereof intersect with the first and second reference lines 302 and 303 respectively. As a consequence, a sufficiently large air pocket size L3 of the spark plug 1 is secured, thereby preventing generation of side sparks.

The pair of thick-walled portions 105*a* is arranged in those places where the distance between the inner surface of the metal shell 10 and the outer surface of the insulator 11 is large. As a consequence, the ground electrodes 20 and 21 that have a large cross-sectional area and sufficient strength are joined to the thick-walled portions 105*a* without reducing the air pocket size L3 of the spark plug 1. In addition, it is preferable that the pair of thick-walled portions 105*a* has a thickness T2 in the radial direction of the metal shell 10 not smaller than 0.8 mm, thereby securing sufficient thickness of the ground electrodes 20 and 21.

Further, the two ground electrodes 20 and 21 are joined to the pair of thick-walled portions 105*a* such that the distances between the center electrode 12 and the ground electrode 20 and between the center electrode 13 and the ground electrode 21 become short. As a consequence, the two ground electrodes 20 and 21 are prevented from being too long, thereby securing sufficient strength thereof.

Furthermore, with the help of the thick-walled portions 105*a* the end surface area of the metal shell end portion 103 is increased. Accordingly, the volume of the air pocket that is formed between the inner surface of the metal shell 10 and the outer surface of the insulator 11 is reduced, thereby preventing pre-ignition of the air-fuel mixture.

Second to Fifth Embodiments

Figure 6C:
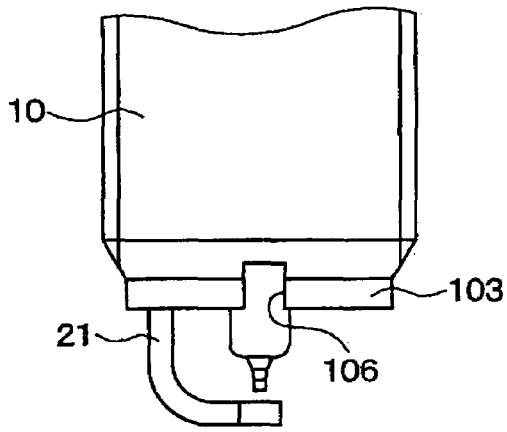
FIG. 6C is a side elevation view of the spark plug of FIG. 6A from the left side thereof.
Figure 6A:
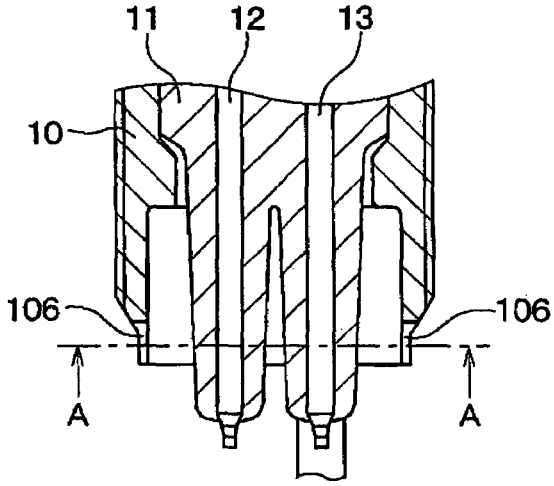
FIG. 6A is a partially cross-sectional side view showing a substantial part of a spark plug according to the second embodiment of the invention.
Figure 6B:
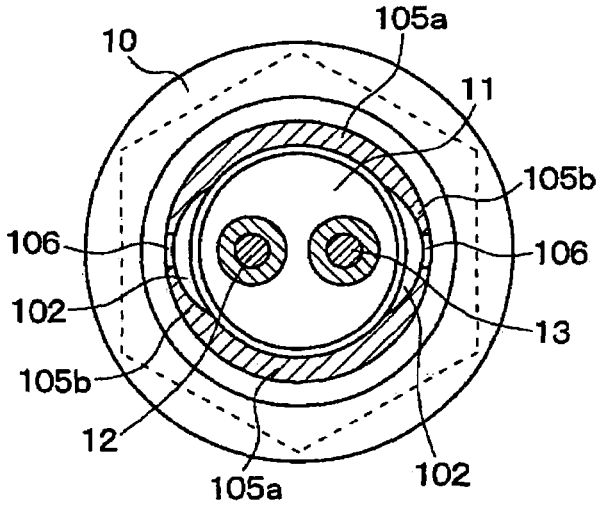
FIG. 6B is a view in cross-section along lines A-A of the FIG. 6A.

FIGS. 6A-6C show a substantial part of a spark plug according to the second embodiment of the present invention.

The spark plug has a structure almost identical to that of the spark plug 1 according to the first embodiment; accordingly, only the difference between those structures is described below.

The spark plug has, as shown in FIG. 6B, a pair of thin-walled portions 105*b* each of which has a cut 106 that is formed through cutting away the thinnest part of the portion 105*b*. Further, referring to FIG. 6C, the cut 106 has the shape of a rectangle when viewed from a side of the spark plug.

When the thickness of the thin-walled portions 105*b* is reduced, for the purpose of securing sufficient air pocket size of the spark plug, to the level thinner than 0.5 mm, the metal shell end portion 103 of the spark plug will collapse, thus resulting in burrs formed therein. Due to the burrs, the spark plug may not be smoothly fit in or removed from the combustion chamber.

Through cutting away the thinnest parts of the thin-walled portions 105*b* in advance, the metal shell end portion 103 of the spark plug according to the present embodiment is prevented from collapsing.

Figure 7:
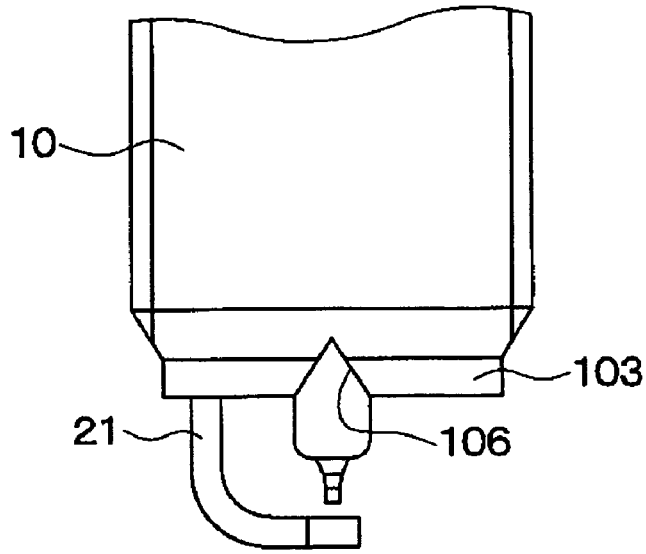
FIG. 7 is a side elevation view showing a substantial part of a spark plug according to the third embodiment of the invention.
Figure 8:
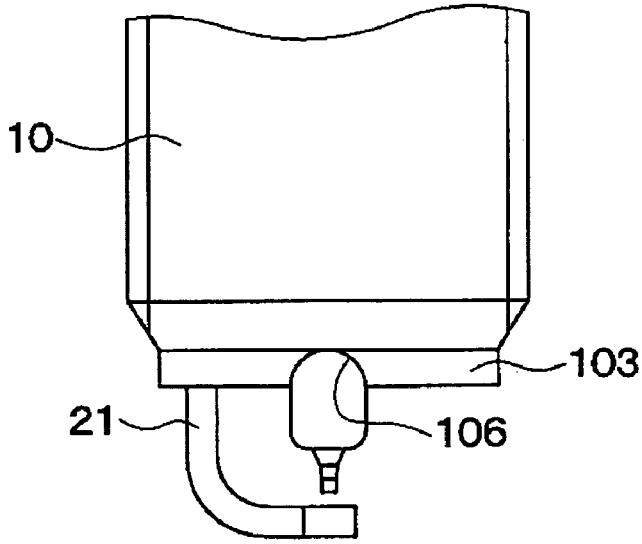
FIG. 8 is a side elevation view showing a substantial part of a spark plug according to the fourth embodiment of the invention.
Figure 9:
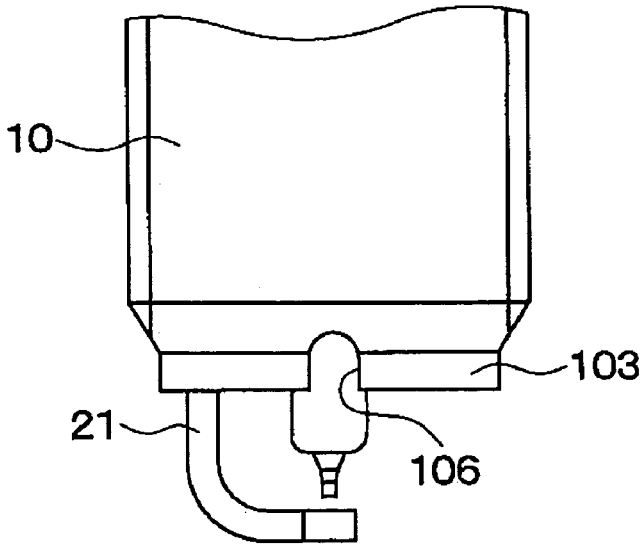
FIG. 9 is a side elevation view showing a substantial part of a spark plug according to the fifth embodiment of the invention.

Moreover, the cut 106*c* in the thin-walled portions 105 may have the shape of a triangle as shown in FIG. 7 according to the third embodiment, the shape of a semicircle as shown in FIG. 8 according to the fourth embodiment, or the U-shape as shown in FIG. 9 according to the fifth embodiment of the invention

.

Sixth Embodiment

Figure 10:
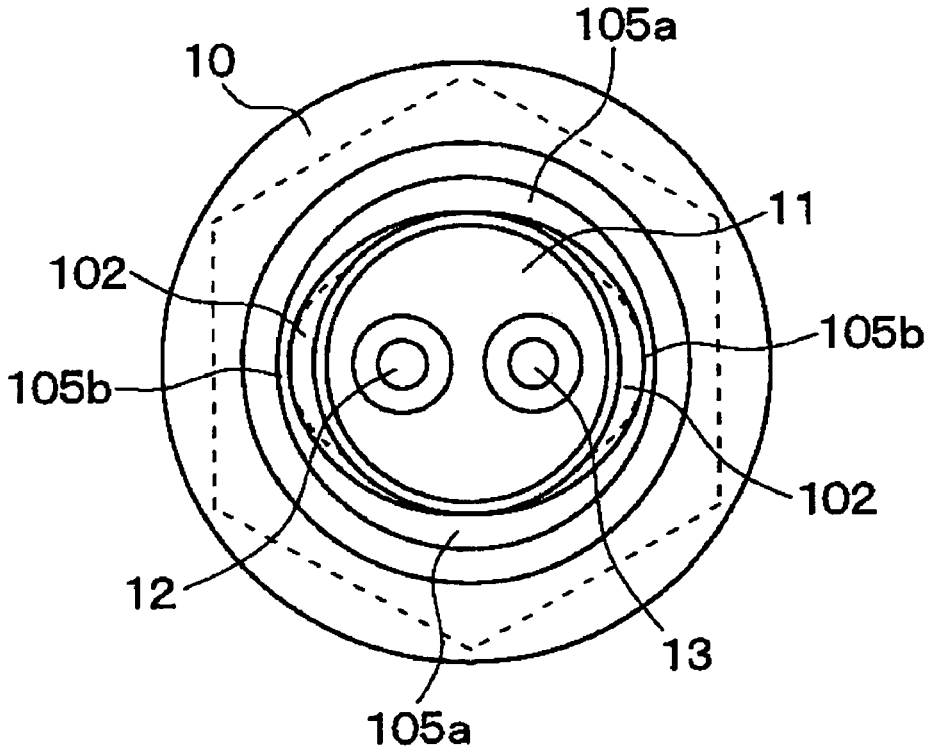
FIG. 10 is an end view showing a spark plug according to the sixth embodiment of the invention omitting ground electrodes thereof.

FIG. 10 shows the end of the metal shell 10 of a spark plug according to the sixth embodiment of the present invention, omitting the ground electrodes thereof.

In the first embodiment of the invention, the inner surface of the metal shell end portion 103 is formed with a plurality of circular arcs; however, it is formed with an ellipse in the present embodiment. As a result, rapid change of thickness in the interfaces between the thick-walled portions 105*a* and the thin-walled portions 105*b* is prevented, thereby facilitating the fabrication of the metal shell 10 when it is fabricated, for example, by cold forging.

Seventh Embodiment

Figure 11:
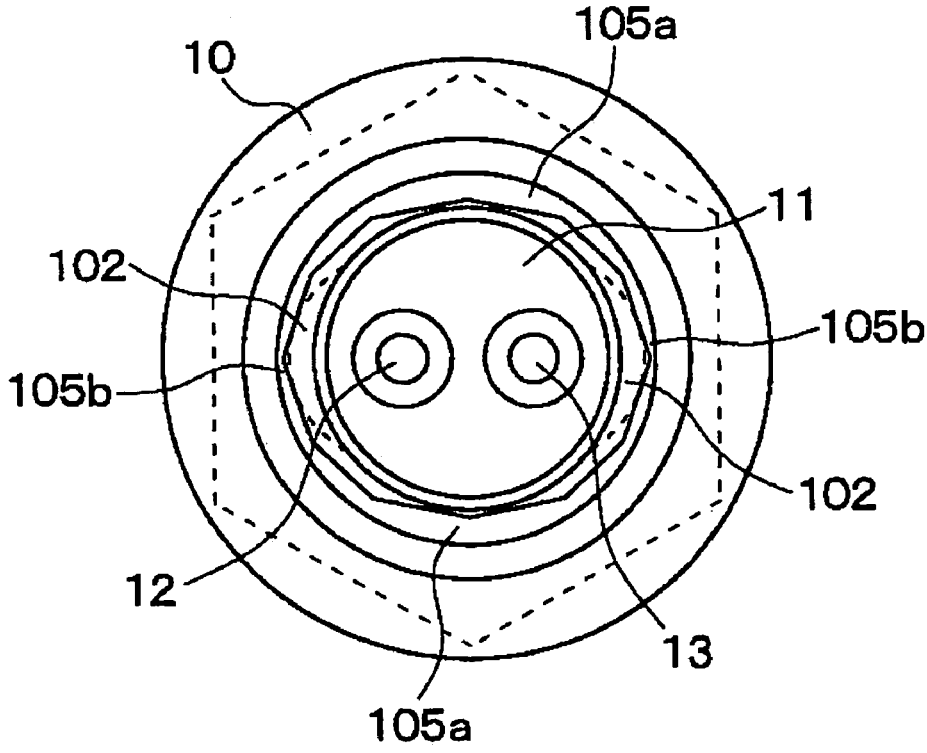
FIG. 11 is an end view showing a spark plug according to the seventh embodiment of the invention omitting ground electrodes thereof.

FIG. 11 shows the end of the metal shell 10 of a spark plug according to the seventh embodiment of the present invention, omitting the ground electrodes thereof.

The only difference between the structure of the spark plug and that of the spark plug 1 according to the first embodiment is that the inner surface of the metal shell end portion 103 of the spark plug is formed with a polygon, while that of the spark plug 1 is formed with the plurality of circular arcs.

The formation of the inner surface of the metal shell end portion 103 according to the present embodiment can also secure the necessary air pocket size of the spark plug while enabling the ground electrodes of the spark plug to be joined to the metal shell end portion 103 through a sufficiently large interface therebetween.

Eighth Embodiment

Figure 12A:
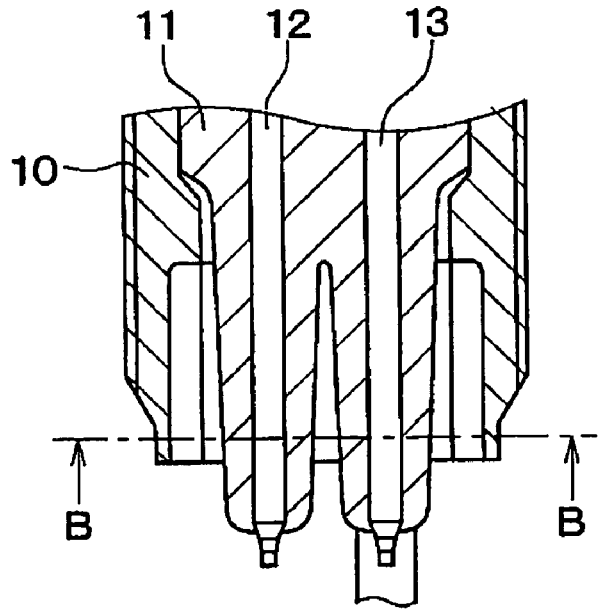
FIG. 12A is a partially cross-sectional side view showing a substantial part of a spark plug according to the eighth embodiment of the invention.
Figure 12B:
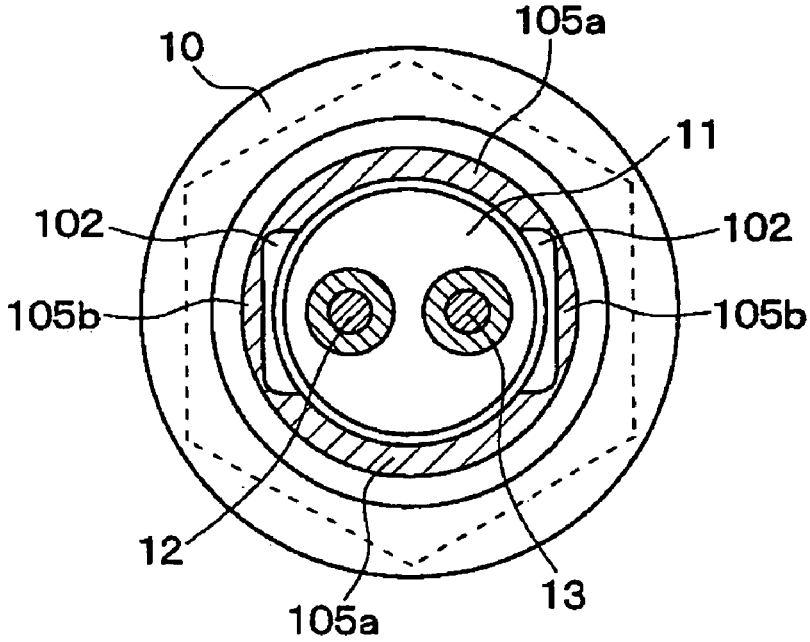
FIG. 12B is a view in cross-section along lines B-B of the FIG. 12A.

FIGS. 12A-12B show the end of the meal shell 10 of a spark plug according to the eighth embodiment of the present invention, omitting the ground electrodes thereof.

The only difference between the structure of the spark plug and that of the spark plug 1 according to the first embodiment is that the inner surface of the metal shell end portion 103 of the spark plug is formed with a plurality of circular arcs and a plurality of straight lines, while that of the spark plug 1 is formed with the plurality of circular arcs.

More specifically, the pair of thin-walled portions 105*b* of the spark plug according to the present embodiment each includes an inner surface having the shape of a rectangle so as to further reduce the thickness of the thin-walled portions 105*b*, thereby improving the effect of suppressing side sparks.

Ninth Embodiment

Figure 13A:
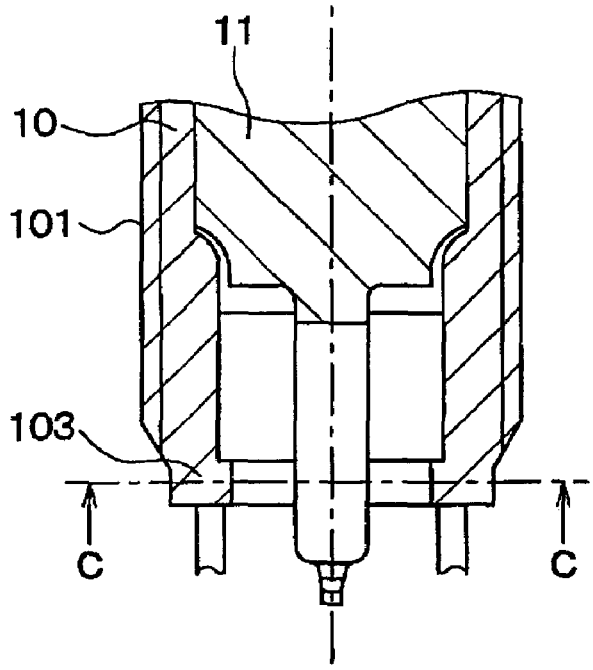
FIG. 13A is a partially cross-sectional side view showing a substantial part of a spark plug according to the ninth embodiment of the invention.
Figure 13B:
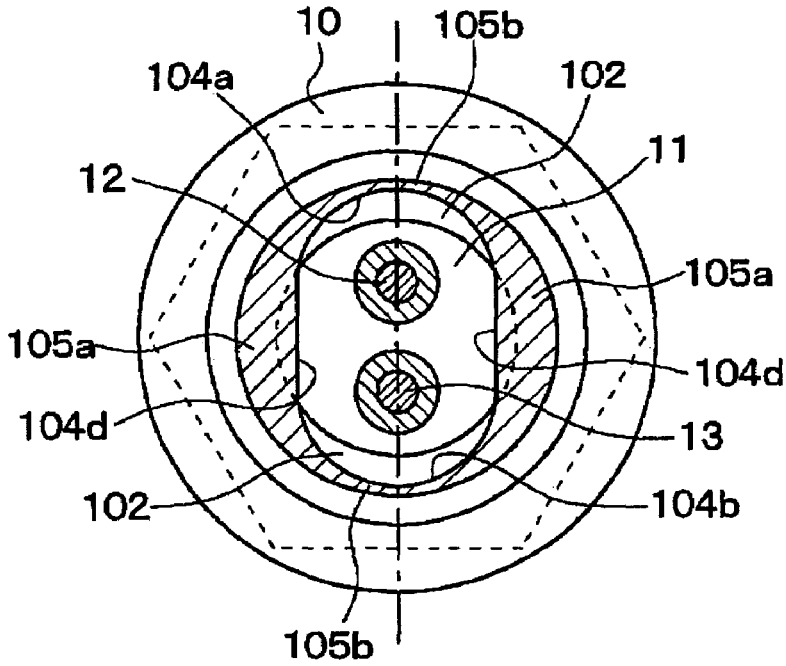
FIG. 13B is a view in cross-section along lines C-C of the FIG. 13A.

FIGS. 13A-13B show the end of the metal shell 10 of a spark plug according to the ninth embodiment of the present invention, omitting the ground electrodes thereof.

The only difference between the structure of the spark plug and that of the spark plug 1 according to the first embodiment is that the inner surface of the metal shell end portion 103 of the spark plug is formed with a plurality of circular arcs and a plurality of straight lines, while that of the spark plug 1 is formed with the plurality of circular arcs.

More specifically, each of the pair of thick-walled portions 105*a* of the spark plug according to the present embodiment includes an inner surface having the shape of a rectangle, so that both of the thick-walled portions 105*a* become closer to the axis of the metal shell 10 than the annular ridge 102 of the metal shell 10. As a result, the thickness of the thick-walled portions 105*a* is increased, thereby enabling the ground electrodes of the spark plug to be joined to the metal shell end portion 103 through an increased interface therebetween.

Tenth to Twelfth Embodiments

Figure 14:
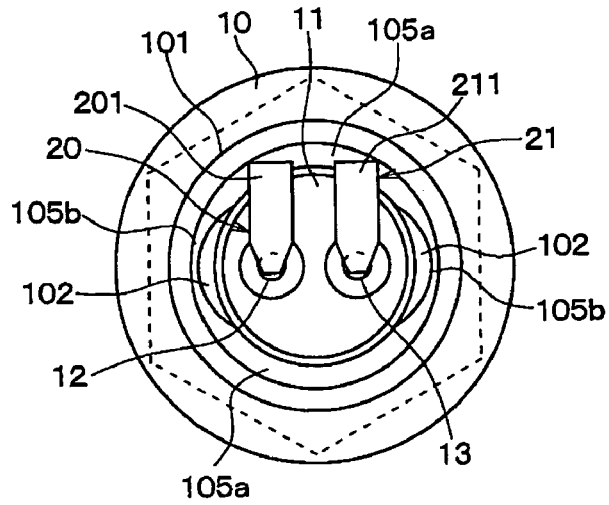
FIG. 14 is an end view of a spark plug according to the tenth embodiment of the invention.

FIG. 14 is an end view showing a spark plug according to the tenth embodiment of the invention. In the spark plug, the two ground electrodes 20 and 21 are joined to the metal shell end portion 103 such that, when viewed along the axis of the spark plug, they are parallel to each other and both of them are joined to the same thick-walled portion 105*a* of the metal shell end portion 103.

Figure 15:
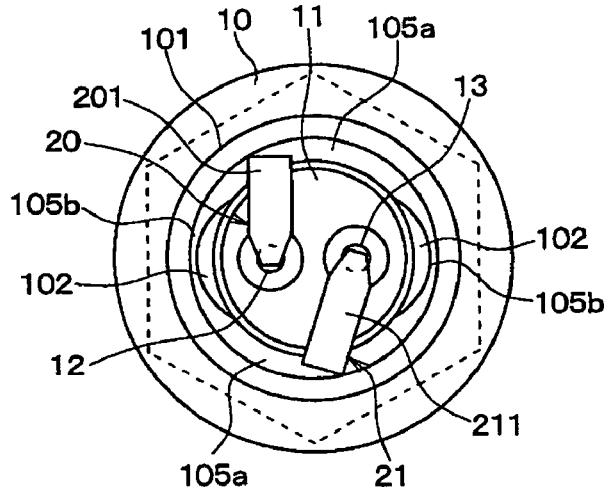
FIG. 15 is an end view of a spark plug according to the eleventh embodiment of the invention.

FIG. 15 is an end view of a spark plug according to the eleventh embodiment of the invention. In the spark plug, the two ground electrodes 20 and 21 are joined to the metal shell end portion 103 such that, when viewed along the axis Z1 of the spark plug, they are not parallel to each other and each is joined to a different thick-walled portion 105*a* of the metal shell end portion 103.

Figure 16:
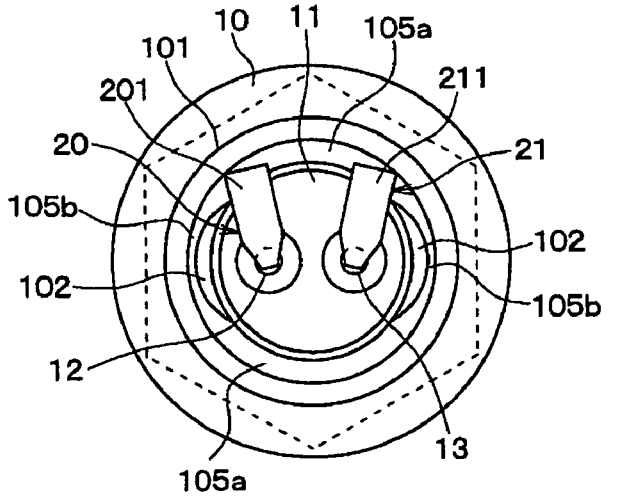
FIG. 16 is an end view of a spark plug according to the twelfth embodiment of the invention.

FIG. 16 is an end view showing a spark plug according to the twelfth embodiment of the invention. In the spark plug, the two ground electrodes 20 and 21 are joined to the metal shell end portion 103 such that, when viewed along the axis of the spark plug, they are not parallel to each other and both of them are joined to the same thick-walled portion 105*a* of the metal shell end portion 103.

Thirteenth and Fourteenth Embodiments

Figure 17:
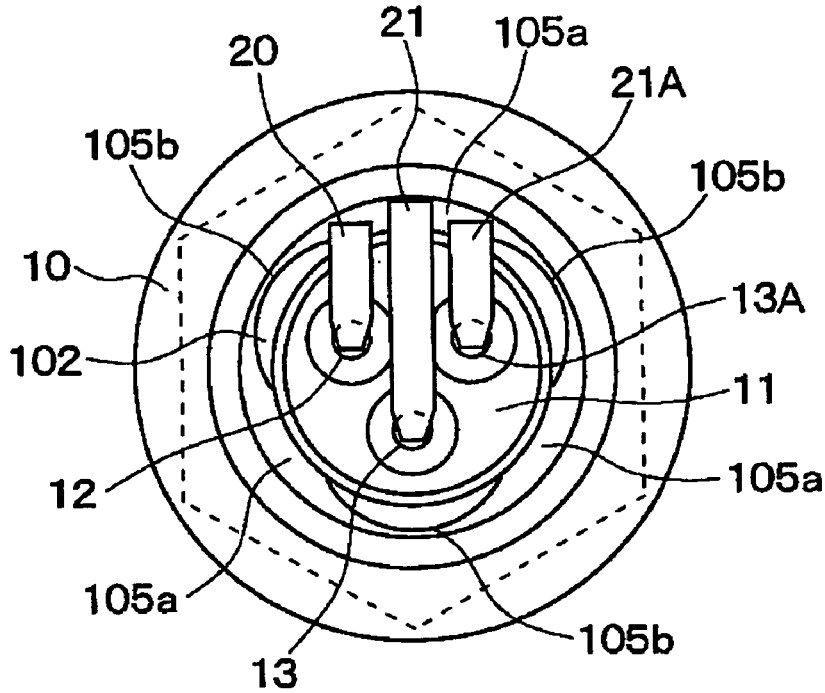
FIG. 17 is an end view of a spark plug according to the thirteenth embodiment of the invention.
Figure 18:
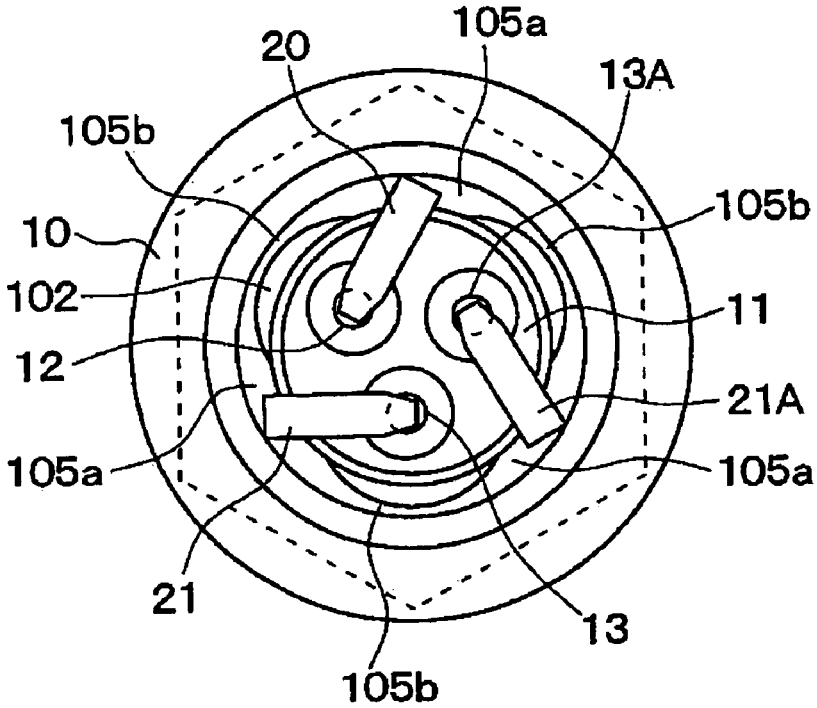
FIG. 18 is an end view of a spark plug according to the fourteenth embodiment of the invention.

FIG. 17 is an end view showing a spark plug according to the thirteenth embodiment of the invention.

The spark plug has three center electrodes 12, 13, and 13A, and three ground electrodes 20, 21, and 21A each of which forms a spark gap in the spark plug together with a corresponding one of the three center electrodes. Also, in the spark plug, there are three thick-walled portions 105*a* and three thin-walled portions 105*b* formed in the metal shell end portion 103. Furthermore, the three ground electrodes are joined to the metal shell end portion 103 such that, when viewed along the axis of the spark plug, they are parallel to each other and all of them are joined to the same thick-walled portion 105*a* of the metal shell end portion 103.

Similarly, FIG. 15 shows the end of a spark plug according to the fourteenth embodiment of the invention.

The spark plug has three center electrodes 12, 13, and 13A, and three ground electrodes 20, 21, and 21A; there are three thick-walled portions 105*a* and three thin-walled portioned 105*b* formed in the metal shell end portion 103 of the spark plug. The three ground electrodes are joined to the metal shell end portion 103 such that, when viewed along the axis of the spark plug, they are not parallel to each other and each is joined to a different thick-walled portion 105*a* of the metal shell end portion 103.

While the above particular embodiments of the invention have been shown and described, it will be understood by those who practice the invention and those skilled in the art that various modifications, changes, and improvements may be made to the invention without departing from the spirit of the disclosed concept. Such modifications, changes, and improvements within the skill of the art are intended to be covered by the appended claims.

What is claimed is:

1. A spark plug for an internal combustion engine comprising:

a tubular metal shell having an axis, said metal shell also having a first end portion to be disposed in a combustion chamber of an internal combustion engine and a second end portion opposed to the first end portion;

a cylindrical insulator fixed in said metal shell, said insulator having a first end exposed outside the first end portion of said metal shell and a second end opposite to the first end, said insulator also having a plurality of bores formed therein which extend from the first end to the second end of said insulator;

a plurality of center electrodes each of which is retained within one of the bores in said insulator, said center electrodes each having an axis;

a plurality of thick-walled portions formed in the first end portion of said metal shell, a plurality of ground electrodes each of which is joined to one of said plurality of thick-walled portions; and a plurality of thin-walled portions formed in the first end portion of said metal shell, each of said thin-walled portions having an inner surface which is outwardly recessed in an angular range that includes an intersection of the inner surface with a reference line, the reference line being defined to extend from the axis of said metal shell through the axis of one of said plurality of center electrodes on a reference plane that is defined to extend perpendicular to the axis of said metal shell through an inner edge of the first end portion of said metal shell.

2. The spark plug as set forth in claim 1, wherein each of said plurality of thick-walled portions of said metal shell has a thickness greater than or equal to 0.8 mm.

3. The spark plug as set forth in claim 2, wherein each of said plurality of ground electrodes is joined to a part of one of said plurality of thick-walled portions, the part of the thick-walled portion intersecting, on the reference plane, with a line extending through the axis of one of said plurality of center electrodes perpendicular to the reference line that passes the axis of the center electrode and the axis of said metal shell.

4. The spark plug as set forth in claim 3, wherein the first end portion of said metal shell has a cross-sectional area on the reference plane greater than or equal to 39.2 $mm^2$.

5. The spark plug as set forth in claim 4, wherein a portion of said insulator, which is surrounded by the first end portion of said metal shell, has a minimum thickness of side walls forming the plurality of bores in said insulator in a range of 0.5 to 0.8 mm.

6. The spark plug as set forth in claim 5, wherein, on the reference plane, a minimum distance between said insulator and said metal shell in radial direction of said metal shell is in a range of 1.2 to 1.6 mm.

7. The spark plug as set forth in claim 6, wherein each of said plurality of thin-walled portions has a cut formed therein.

8. The spark plug as set forth in claim 2, wherein, on the reference plane, a minimum distance between said insulator and said metal shell in radial direction of said metal shell is in a range of 1.2 to 1.6 mm.

9. The spark plug as set forth in claim 1, wherein each of said plurality of ground electrodes is joined to a part of one of said plurality of thick-walled portions, the part of the thick-walled portion intersecting, on the reference plane, with a line extending through the axis of one of said plurality of center electrodes perpendicular to the reference line that passes the axis of the center electrode and the axis of said metal shell.

10. The spark plug as set forth in claim 1, wherein the first end portion of said metal shell has a cross-sectional area on the reference plane greater than or equal to 39.2 $mm^2$.

11. The spark plug as set forth in claim 1, wherein a portion of said insulator, which is surrounded by the first end portion of said metal shell, has a minimum thickness of side walls forming the plurality of bores in said insulator in a range of 0.5 to 0.8 mm.

12. The spark plug as set forth in claim 1, wherein, on the reference plane, a minimum distance between said insulator and said metal shell in radial direction of said metal shell is in a range of 1.2 to 1.6 mm.

13. The spark plug as set forth in claim 1, wherein each of said plurality of thin-walled portions has a cut formed therein.

14. The spark plug as set forth in claim 1, wherein an inner surface of the first end portion of said metal shell is formed with a plurality of circular arcs.

15. The spark plug as set forth in claim 14, wherein the inner surface of the first end portion of said metal shell is formed with a plurality of circular arcs each of which has a center on the axis of one of said plurality of center electrodes, and a plurality of circular arcs each of which has a center on the axis of said metal shell.

16. The spark plug as set forth in claim 1, wherein an inner surface of the first end portion of said metal shell is formed with an ellipse.

17. The spark plug as set forth in claim 1, wherein an inner surface of the first end portion of said metal shell is formed with a plurality of circular arcs and a plurality of straight lines.

18. The spark plug as set forth in claim 1, wherein an inner surface of the first end portion of said metal shell is formed with a polygon.

19. The spark plug as set forth in claim 1, wherein said metal shell further has an annular ridge that extends inwardly from an inner surface of said metal shell and is spaced from the first end portion of said metal shell, and wherein, all of the plurality of thick-walled portions are formed closer to the axis of said metal shell than the annular ridge of the metal shell.

* * * * *

UNITED STATES PATENT AND TRADEMARK OFFICE

CERTIFICATE OF CORRECTION

PATENT NO. : 7,282,845 B2
APPLICATION NO. : 10/986307
DATED : October 16, 2007
INVENTOR(S) : Hiramatsu It is certified that error appears in the above-identified patent and that said Letters Patent is hereby corrected as shown below:

Title Page item [73]

Assignee, "Denso Corpoartion, Kariya, Aichi-Pref. (JP)" to read:

--Denso Corporation, Kariya, Aichi-Pref. (JP)--

Signed and Sealed this

First Day of April, 2008

JON W. DUDAS
*Director of the United States Patent and Trademark Office*